US005566602A

United States Patent [19]

Dennis

[11] Patent Number: 5,566,602

[45] Date of Patent: Oct. 22, 1996

[54] FOOD PRODUCT SLICER

[76] Inventor: Clarence Dennis, 2332 Field Stone Dr., Mendota Heights, Minn. 55120

[21] Appl. No.: 377,169

[22] Filed: Jan. 24, 1995

Related U.S. Application Data

[62] Division of Ser. No. 102,545, Aug. 5, 1993, Pat. No. 5,383,384.

[51] Int. Cl.[6] ..... B26D 1/10

[52] U.S. Cl. ..... 83/168; 83/247; 83/762

[58] Field of Search ..... 83/268, 761, 762, 83/764, 168, 247

[56] References Cited

U.S. PATENT DOCUMENTS

| | | | |
|---|---|---|---|
| 1,405,720 | 2/1922 | Scott | 83/762 |
| 1,623,498 | 4/1927 | Sandbeck | 83/762 |
| 2,115,451 | 4/1938 | All | 83/762 |
| 2,347,818 | 5/1944 | Folk | 83/268 |
| 2,407,658 | 9/1946 | Fuchs | 83/762 |
| 4,964,323 | 10/1990 | Fortney | 83/764 |

*Primary Examiner*—Kenneth E. Peterson
*Attorney, Agent, or Firm*—James W. Miller

[57] ABSTRACT

A slicer is provided for use in conjunction with a manually manipulated knife for cutting slices off one end of a loaf of a food product, such as a loaf of bread, a loaf of meat, a loaf of cheese, etc. The slicer includes a U-shaped channel in which the food product loaf is contained with one end of the loaf being in engagement with an end wall. The channel is inclined to the horizontal to cause the loaf to self feed down into engagement with the end wall. A knife slot is provided a fixed distance away from the end wall to allow a slice having a first pre-determined thickness to be provided. One or more thickness adjustment plates may be dropped down into the channel to overlie the end wall to decrease the thickness of the slices in pre-determined increments equal to the thickness of the plates. The plates extend above the end wall to be easily removable from the channel. The slicer includes a gripping member for engaging one side of the loaf to force the loaf into engagement with a side wall of the channel, the gripping member being freely movable in a transverse direction during use of the slicer to allow the gripping member to be held by hand pressure against the side of the loaf without risk to the user.

7 Claims, 3 Drawing Sheets

FOOD PRODUCT SLICER

This application is a division of application Ser. No. 08/102,545, filed Aug. 5, 1993, now U.S. Pat. No. 5,383, 384.

TECHNICAL FIELD

This invention relates to a slicer for holding a loaf of bread, or a similar food product provided in loaf form, to allow slices to,be cut off the end of the loaf by a manually held and manipulated knife.

BACKGROUND OF THE INVENTION

Food products of various types are often provided in large chunks or loaves which are typically sliced into relatively thin slices. For example, "deli" type meat products are usually provided in elongated loaf type form, and slices are cut from the end of the loaf as required. The same is true of many cheeses. While bread loaves can be bought in either cut or uncut form, most bread purchased in grocery stores might be pre-sliced, or the purchaser could have the store or bakery slice the bread if so desired. However, if the bread is not sliced at the store or bakery, or if the bread is home baked, then the user must cut slices in order to use the bread.

While specialized slicers are used in commercial establishments for slicing meat or bread products, these slicers are relatively large, motorized products which are not generally suitable for home use. Many meat slicers include a rotatable, motorized cutting blade with the loaf of meat being held against the cutting blade and moved back and forth across the blade to cut sequentially slices of meat off the end of the loaf. Bread slicers often include a plurality of vertical, reciprocating saw blades spaced apart by the thickness of the desired slices, with the bread loaf being pushed through the saw blades to slice the entire loaf in one action. Again, these slicers are generally too expensive for home use.

In addition, cutting an entire loaf of bread all at once is disadvantageous if the bread is not consumed quickly, particularly for home baked bread lacking preservatives, since the bread tends to dry out rapidly. It would be better to cut off just individual slices as needed and leave the rest of the bread loaf intact.

Obviously, a loaf of bread could be cut simply by holding the loaf of bread in place with one hand and using the other hand to manipulate a knife to cut slices off the end of the loaf. However, this is not ideal for a number of reasons. Gripping the loaf tightly with the hand tends to crush the bread while it is being cut. In addition, it is difficult to cut slices having a consistent thickness, or to adjust easily the thickness of the sliced bread, simply using an unsupported knife. Finally, if the user is not careful, there is a possibility that the user might accidentally cut his or her fingers with the knife blade.

Various devices are known for use with a manual knife to help hold a loaf of bread when slicing the bread. Many of these devices comprise channel shaped boxes in which the loaf of bread is placed, with the side walls of the boxes having a plurality of knife slots spaced along the length thereof so that multiple slices can be cut one after another along the length of the loaf. Often, these slots are spaced at different distances from one another to allow the bread slices to have various thicknesses. U.S. Pat. No. 1,072,450, to Hamblin U.S. Pat. No. 1,131,333 to Coon and U.S. Pat. No. 4,964,323 to Fortney disclose devices of this type.

While these devices are more effective than simply using an unsupported knife to slice the bread, they have various disadvantages. For one thing, the knife slots in each side wall have to be precisely aligned with all the other slots in the other side wall to allow the knife blade to pass across the width of the box to slice the bread. The need for such an alignment, and the use in the first place of multiple slots spaced apart in an array of such slots, makes the construction of such a device relatively labor intensive, and accordingly more complex and expensive. In addition, to adjust the thickness of the bread slices, the end of the bread loaf has to be positioned appropriately adjacent to those knife slots having the right spacing from adjacent slots. This can be difficult and time consuming to do, thus making the device complex to use if slices having different thicknesses are required.

SUMMARY OF THE INVENTION

It is one aspect of this invention to provide a slicer for holding food product loaves during a slicing operation which is simple, durable and easy to use, and which can also be easily adjusted to vary the thickness of the slices that are being cut.

These and other aspects of this invention are provided by a food product slicer for use with a knife for cutting slices of food product from a loaf of food product. The slicer comprises a bottom wall on which a loaf of food product may be laid for cutting a slice of food product off one end of the loaf. An upright end wall is secured to the bottom wall and extends upwardly therefrom. The end wall includes a front face which is substantially perpendicular to the food product loaf to allow the one end of the food product loaf to be abutted against the front face of the end wall. A means is fixed relative to the end wall for guiding a knife blade in a direction parallel to the end wall for cutting a food product slice having a first pre-determined thickness equal to the distance between the front face of the end wall and the knife guiding means. A means is provided for selectively adjusting the thickness of the food product slices. The thickness adjusting means comprises at least one thickness adjustment plate which is suited to be placed against the front face of the end wall such that the one end of the food product loaf is then in engagement with a front face of the adjustment plate, whereby a food product slice can be selectively cut having a first adjusted thickness which is equal to the distance between the front face of the adjustment plate and the knife guiding means by selectively placing the adjustment plate in engagement with the end wall.

BRIEF DESCRIPTION OF THE DRAWINGS

This invention will be described more completely hereafter in the Detailed Description, when taken in conjunction with the following drawings, in which like reference numerals refer to like elements throughout.

DETAILED DESCRIPTION

Figure 1:
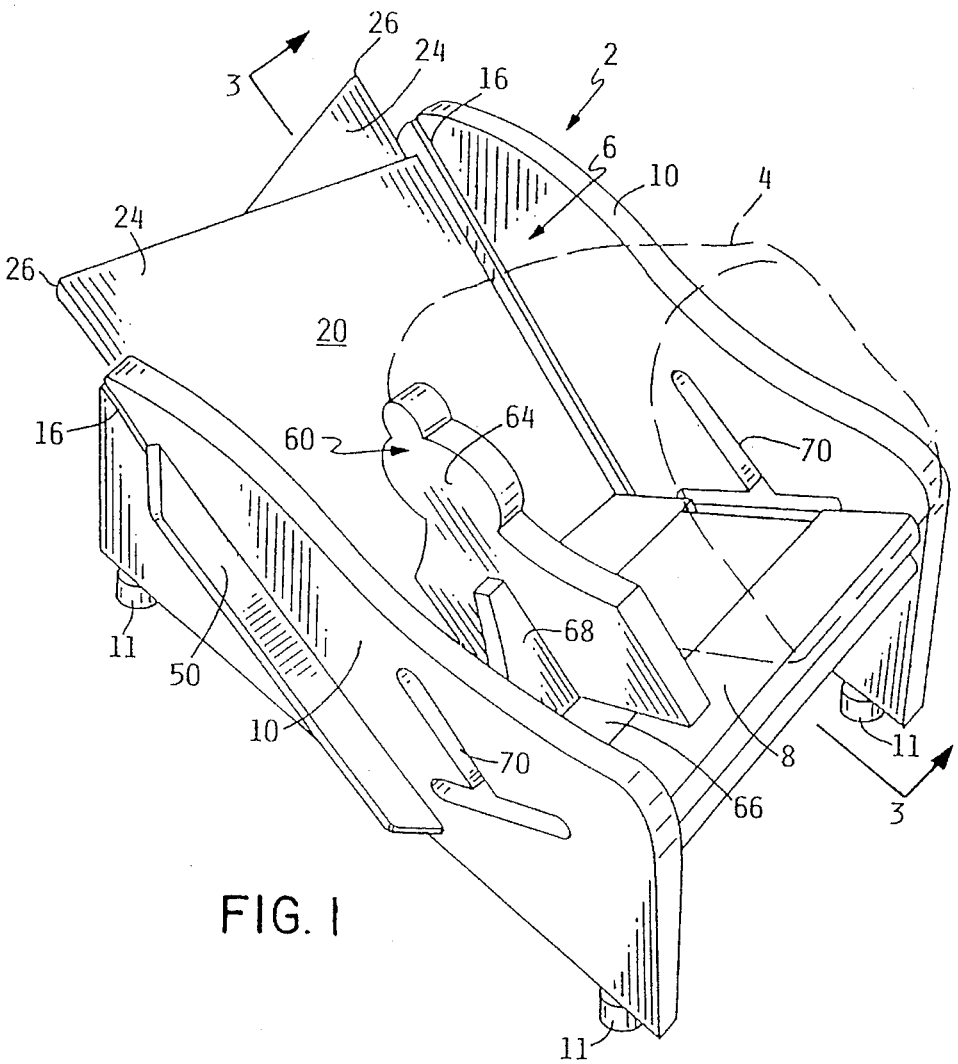
FIG. 1 is a perspective view of a first embodiment of a bread slicer according to the present invention, showing a loaf of bread in phantom lines which loaf is held in the slicer to allow slices to be cut from one end of the loaf and particularly illustrating two thickness adjustment plates in place in the slicer to adjust the thickness of the bread slice being cut.

Referring first to FIG. 1, a first embodiment of a bread slicer according to this invention is illustrated as 2. Slicer 2 is intended for use with a bread slicing knife having a handle and an elongated knife blade, preferably a serrated blade. The knife is not shown in the drawings, but is received in a knife guiding means provided in slicer 2. The knife does not itself necessarily form a part of slicer 2 of this invention, though some type of knife must obviously be used to cut slices of bread off the bread loaf 4. As a practical matter, many people already own bread slicing knives and slicer 2 could be sold without a knife such that the purchaser would use one of the knives already owned by the purchaser with slicer 2. However, if desired, a knife could also be packaged with and sold as part of slicer 2, forming a portion thereof.

Slicer 2 comprises a generally U-shaped trough or channel 6 for holding a loaf of bread therein. A single loaf 4 of bread is shown in FIG. 1 in phantom lines received in channel 6. Channel 6 is formed by a bottom wall 8 on which bread loaf 4 is received and by two transversely spaced apart side walls 10 which extend upwardly from bottom wall 8 such that loaf 4 is received between side walls 10. A plurality of feet 11 are provided at suitable spots on the underside of side walls 10 to allow slicer 2 to be supported on a horizontal surface, such as a table or countertop. Feet 11 can be made of rubber or some suitable material that will not mar or scratch the table or countertop.

One end of the U-shaped channel 6 formed by the bottom and side walls 8 and 10 is closed off by an upright end wall 12. One end of bread loaf 4 is abutted against a front face 14 of end wall 12 when bread loaf 4 is received in channel 6. Desirably, channel 6 is sloped relative to the horizontal so that the bread loaf 4 will be fed by gravity down into engagement with end wall 12, as shown in FIG. 1. This is one aspect of this invention that facilitates and eases the bread slicing action. The angle of inclination of bottom wall 8 relative to a horizontal plane could obviously be varied, but is preferably in the range of from 30° to 45° relative to the horizontal.

Figure 3:
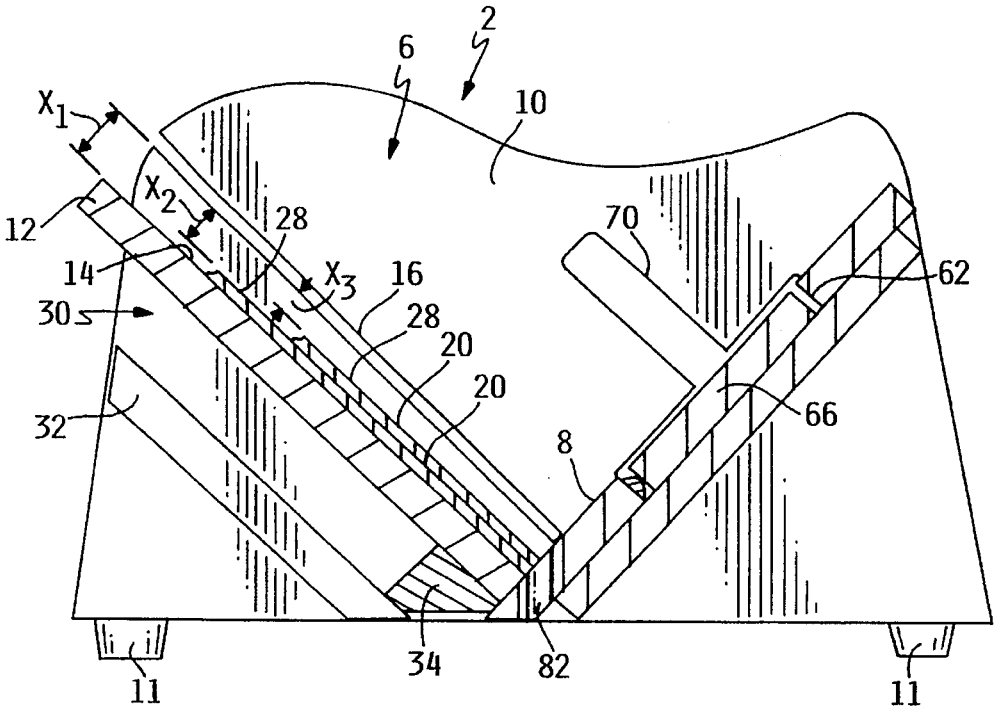
FIG. 3 is a cross-sectional view of the bread slicer shown in FIG. 1 taken along lines 3—3 in FIG. 1, with portions of the thickness adjustment plates being broken away to illustrate the various thicknesses of bread slices that may be obtained from selective use of the plates.

Referring now to FIG. 3, slicer 2 includes means for guiding the blade of the bread slicing knife in a direction parallel to front face 14 of end wall 12. This knife guiding means includes elongated knife slots 16 that extend down through each side wall 10 from the top of side wall 10 to bottom wall 8 of channel 6. Knife slots 16 in side walls 10 are longitudinally aligned with one another to allow the blade knife to pass .down through both slots simultaneously with the handle of the knife being located outside of the side walls of slicer 2. As seen most clearly in FIG. 3, a first pre-determined distance referred to as $x_1$ is formed between front face 14 of end wall 12 and the leading edge of each knife slot 16. Thus, if a loaf of bread is in place in slicer 2 with its one end in engagement with front face 14 of end wall 12, and the knife is manipulated to cause a slicing or sawing action of the knife blade down through knife slots 16, a slice of bread is cut off the end of loaf 4 having a first pre-determined thickness equal to the distance $x_1$.

Figure 5:
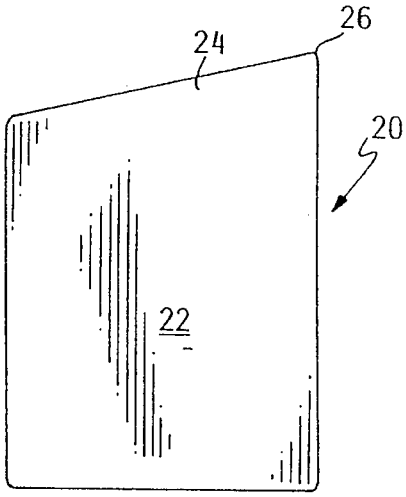
FIG. 5 is a top plan view of one of the thickness adjustment plates shown in FIG. 1.
Figure 6:
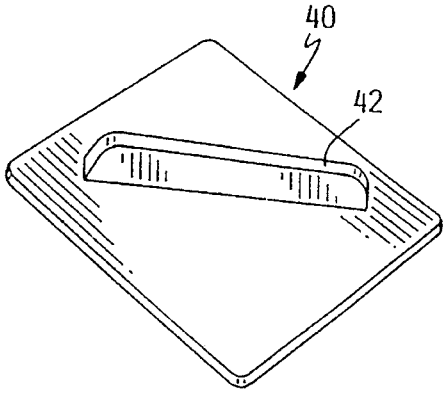
FIG. 6 is a top plan view of the bread pusher member shown in FIG. 4.

One aspect of this invention is to provide a slicer 2 having means for easily and quickly adjusting the thickness of the bread slices being cut by slicer 2. This invention provides a plurality of thickness adjustment plates 20, one of which is shown in FIG. 5. Adjustment plate 20 is basically a rectangular planar plate member 22 having a width which is slightly less than the distance between side walls 10 and having a height which is sufficiently high to overlie substantially end wall 12 of slicer 2. The upper section of adjustment plate 20 is formed as a triangular section 24 that defines an upper apex 26. This triangular section 24 forms a handle for allowing adjustment plate 20 to be easily gripped. Preferably, triangular section 24 is shaped to position the apex 26 thereof to one side of plate 20, and not to have apex 26 in the middle, for a purpose to be described hereafter.

Figure 2:
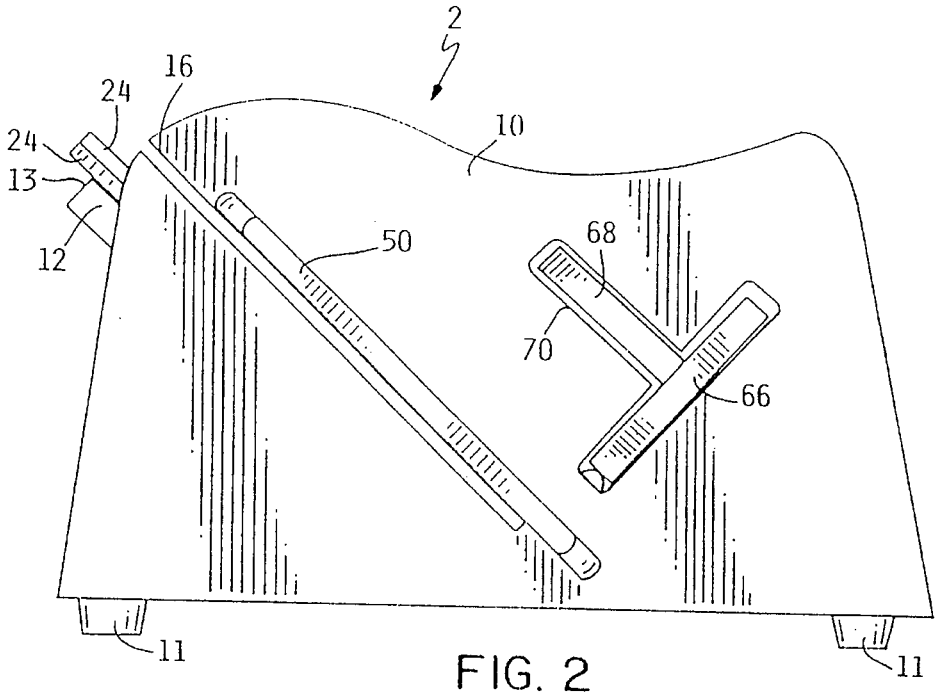
FIG. 2 is a side elevational view of the bread slicer shown in FIG. 1.

In using slicer 2, if a bread slice having a smaller thickness than the thickness $x_1$ normally provided by slicer 2 is desired, it is required that one or more of the thickness adjustment plates 20 be used. Plates 20 are used simply by slipping or dropping plates 20 down into channel 6 formed by side walls 10 until plates 20 abut against end wall 12 of slicer 2 to be positioned between front face 14 of end wall 12 and knife slots 16. This can be done simply by gripping the triangular upper section 24 of each plate 20 adjacent apex 26 and dropping that plate 20 downwardly into place until the lower edge of the plate engages against bottom wall 8. Plates 20 are sufficiently high to overlie substantially end wall 12 of slicer 2, and specifically their triangular upper sections 24 preferably extend above the upper edge 13 of end wall 12, as shown in FIGS. 1 and 2, to allow plates 20 to be easily gripped to lift them out more easily and remove them from slicer 2.

Using a plurality of plates 20 allows the thickness to be adjusted in multiple increments equal to the number of plates. For example, assuming only one plate is placed in engagement with end wall 12, the bread slice being cut will have a first adjusted thickness, shown as $x_2$ in FIG. 3, equal to the distance between front face 28 of plate 20 and the leading edge of knife slot 16. If a still thinner bread slice is desired, then a second adjustment plate 20 can also be dropped down into place, thereby further decreasing the distance between front face 28 of the plate 20 closest to knife slot 16 and the leading edge of knife slot 16 to a second adjusted thickness shown as $x_3$ in FIG. 3. Thus, bread slices having a thickness equal to the distance $x_1$ will be cut if no plates 20 are used between end wall 12 and knife slot 16, bread slices having a first adjusted thickness equal to the distance $x_2$ will be cut if one plate 20 is used between end wall 12 and knife slot 16, and bread slices having a second adjusted thickness equal to the distance $x_3$ will be cut if two plates 20 are used between end wall 12 and knife slot 16.

Obviously, any number of adjustment plates 20 could be used in bread slicer 2, from one plate 20 to more than two plates 20, depending upon the initial distance $x_1$ and the thickness of plates 20. As a practical matter, if the normal or usual thickness of the slice $x_1$ is approximately one-half to five-eighths of an inch, and plates 20 are each ⅛ to 3/16 of an inch in thickness, the use of one or two plates will potentially provide bread slices having adjusted thicknesses which will be sufficient in most cases. However, this invention is not limited for use with a particular number of thickness adjustment plates 20, or to plates 20 having a particular thickness. Use of multiple plates of different thicknesses permits choices of bread slices of graded thicknesses in steps as great or small as desired by the user. For example, the following combinations of plates can lessen the thickness of cut slices as follows:

3/16" One 3/16" plate

1/4" Two 1/8" plates or one 1/4" plate

5/16" One 3/16" plate and one 1/8" plate

7/8" Three 1/4" plates and one 1/8" plate.

When placing adjustment plates 20 in slicer 2, it is desired that plates 20 be reversed to allow their offset apices 26 to be transversely spaced apart, as shown in FIG. 1. This allows the triangular upper section 24 of each plate 20, namely that portion of plate 20 adjacent apex 26, to be easily grabbed without interference from the other adjacent plate 20. Thus, if both plates 20 are in place in channel 6, and it is desired to remove just one of them, this can be done simply by reaching down and grabbing the triangular upper section 24 of one of the plates and pulling that plate 20 upwardly out of channel 2. As one can see in looking at FIG. 1, this will be easy to do since the position of each apex 26 at one side of plate 20, and the reversed position of adjacent plates 20 in channel 6, will alternately position the triangular upper sections 24 of adjacent plates 20 on opposite sides of channel 6.

Figure 4:
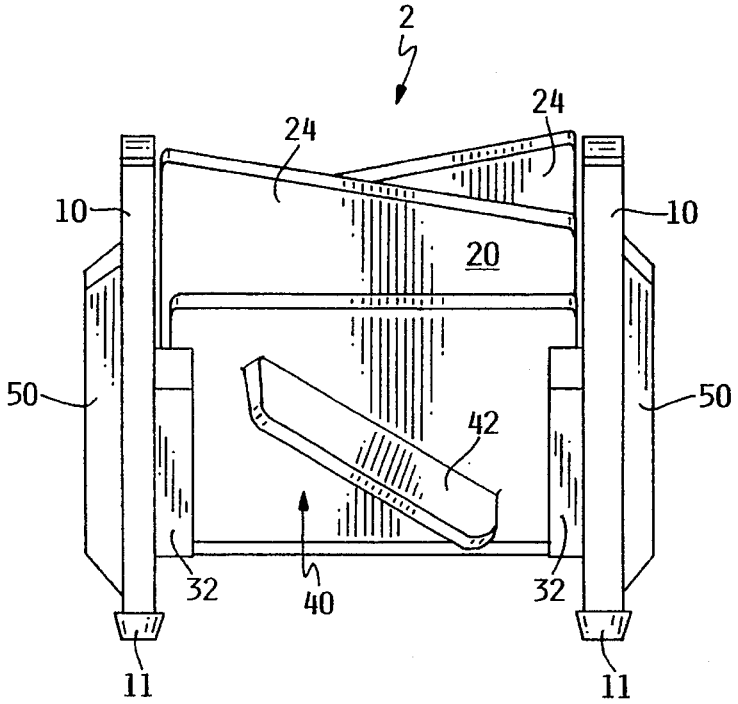
FIG. 4 is a rear elevational view of the bread slicer shown in FIG. 1, particularly illustrating a storage area for holding the thickness adjustment plates and a bread pusher member.

Slicer 2 preferably includes some means for storing thickness adjustment plates 20 thereon. This storing means comprises a storage pocket or chamber 30 formed on the rear side of end wall 12. Referring to FIGS. 3 and 4, two upright ribs 32 are fixedly attached to each side wall 10. Ribs 32 are spaced some distance behind end wall 12 and are parallel to end wall 12. Ribs 32 form the rear of storage chamber 20 and a bottom piece 34 extending between ribs 32 forms the bottom of storage chamber 30. Since the distance between ribs 32 is less than the width of plates 20, plates 20 can simply be dropped down into storage chamber 30 and they will be held in place therein and will be prevented from falling out by ribs 32. The depth of chamber 30, namely the distance between end wall 12 and ribs 32, is sufficient to store both of the thickness adjustment plates 20 and a bread pusher member 40, the pusher member 40 being described hereafter.

In using slicer 2, a loaf of bread is inserted into channel 6 until it rests against bottom wall 8 thereof and has its lower end in engagement with end wall 12, assuming no thickness adjustment plates 20 are being used. The user then inserts the blade of the slicing knife into knife slots 16 with the handle extending outside of bread slicer 2 on whatever side is most convenient to the user, i.e. if the user is right handed the knife handle will extend out from the right side of slicer 2 and vice versa for a left handed user. The user will then grip the bread loaf 4 with the fingers of his or her other hand, and then cut a slice off the lower end of the bread loaf by sawing downwardly with the knife until the knife blade reaches bottom wall 8. This bread slice may then be lifted out of channel 6 and eaten or otherwise used, with the remainder of the loaf of bread self feeding by sliding downwardly in channel 6 to, allow the next slice to be cut off.

When gripping the bread loaf 4 during this cutting action, the user's fingers will often grip against the outside of one of the side walls 10, usually against the side wall which is opposite to the hand that is holding the knife. To prevent any possibility of cutting the user's fingers in this situation, or having the knife blade come in contact with the user's fingers, bread slicer 2 is provided with a guard flange 50 on the outside of side wall 10 in front of knife slot 16. Guard flange 50 extends over most of the length of knife slot 16 between knife slot 16 and the location on side wall 10 against which the user might grab with some of his or her fingers while holding bread loaf 4. Preferably, for a bread slicer 2 that can be used either by left or right handed persons, simply by reversing the direction in which the knife handle points from slicer 2 when the knife is received in slots 16, a guard flange 50 would be provided on each side wall 10 in front of each knife slot 16. However, only one guard flange 50 is shown in FIG. 1 with it being understood that a similar guard flange 50 would be located on the other side wall 10.

Bread slicer 2 could be provided in various sizes with different widths of channel 6 being provided for bread loaves having different widths. However, to allow for some variation in the widths of the bread loaves, the distance between side walls 10 is preferably made large enough to accommodate even the widest bread loaves normally encountered. A transversely movable, bread gripping member 60 could be slidably mounted in a slot 62 provided in bottom wall 8. The purpose of gripping member 60 is to aid in gripping bread loaves 4 of various widths and in holding these loaves in place against one of the side walls 10 during a bread slicing action.

Gripping member 60 includes an upright planar face 64 suited to engage against the side of bread loaf 4. Face 64 is fixed or secured to a slide member 66 that slides in slot 62. If desired, gripping member 60 could include a vertical cross brace 68 extending between face 64 and slide member 66 forming a handle or the like on gripping member 60. Each side wall 10 has a cut-out or apertured portion 70 that allows cross brace 68 and slide member 62 to extend at least partially outside of side wall 10 in order that face 64 could be pulled up flush against the inside surface of side wall 10. Gripping member 60 is completely removable from slot 62 if desired and need not necessarily be used.

Referring to FIG. 1, however, gripping member 60 does allow the user to grip more easily the bread loaf to hold it in place without crushing the side of bread loaf 4. For example, the arrangement of components in FIG. 1 is one that would be used by a left handed user, i.e. the knife blade would extend out from the left or near side of slicer 2 in FIG. 1 to be gripped by the user's left hand and the user would normally use his or her right hand to hold loaf 4 in place. In this regard, the user would slide gripping member 60 into place with the side of loaf 4 as shown in FIG. 1, and would then hold loaf 4 by pushing inwardly on face 64 with the thumb of his or her right hand with the fingers of the user's right hand encircling the top of loaf 4 and then resting against the outside of the right side wall 10 in FIG. 1. In effect, none of the user's fingers or thumbs on the hand holding the bread need directly grip against the sides of bread loaf 4, thereby allowing the bread to be conveniently held when cutting the same. Obviously, a right handed user could achieve the same result, except that gripping member 60 would be reversed in slot 62 from its FIG. 1 orientation and loaf 4 would be pushed up the left side wall 10 by a right handed user. Thus, the loaf of bread is preferably held against the opposite side wall of channel 6 from the knife handle.

As the user slices various slices of bread off loaf 4, the length of loaf 4 will decrease, until finally there is only a short tail of loaf 4 left. When this occurs, gripping member 60 could be pulled to the side and bread pusher member 40 could be inserted into channel 6 behind bread loaf 4 in engagement with the tail end thereof. In this regard, bread pusher member 40 includes a rearwardly extending handle 42 to allow pusher member 40 to be pushed down against the tail end of loaf 4. Pusher member 40 is obviously sized to be received between side walls 10 when pusher member 40 is either removed from channel 6 or pulled over flush against one of side walls 10. Pusher member 40 allows sufficient pressure to be easily exerted against the tail end of loaf 4 to hold and safely cut the last few slices of bread off of loaf 4, without exposing the user's fingers to the knife blade.

Bread slicer 2 according to this invention has numerous advantages not present in prior art structures. It forms a simple, durable and easily usable slicer that is convenient and safe to use. The thicknesses of the bread slices can be easily adjusted by selective use of one or more of the thickness adjustment plates 20. Plates 20 are easily usable simply by dropping them down into channel 6 or by lifting them out of channel 6 from the top thereof, and can conveniently be stored on slicer 2 when not in use.

When very thin slices of bread are being cut, such slices can be torn when removing them by hand from slicer 2. However, the topmost plate 20 (i.e. the plate 20 immediately beneath and in contact with the bread slice) can conveniently serve as a tray or platter to help lift the bread slice out due to the convenient grip provided by the triangular, handle forming section 26 of platter 20. The user need only grip the top plate 20 and lift up underneath the bread slice to remove the bread slice from channel 6.

In addition, the inclined angle of channel 6 allows the bread loaf to feed automatically down into engagement with end wall 12 to reposition automatically loaf 4 when cutting multiple slices of bread and keep it engaged with end wall 12. Bread gripping member 60 allows the user to grip the bread between gripping member 60 and one of the side walls 10 without using his or her fingers to grip either side of loaf 4. In this regard, it may be necessary for the heel of the user's hand to press lightly against the rear end of loaf 4 to keep the front end of loaf 4 engaged with front face 14 of end wall 12, but the user does not have to grip or pinch the sides of loaf 4 if the user employs bread gripping member 60. Bread pusher member 40 allows the last few slices of bread to be safely and easily cut off the end of loaf 4.

Figure 7:
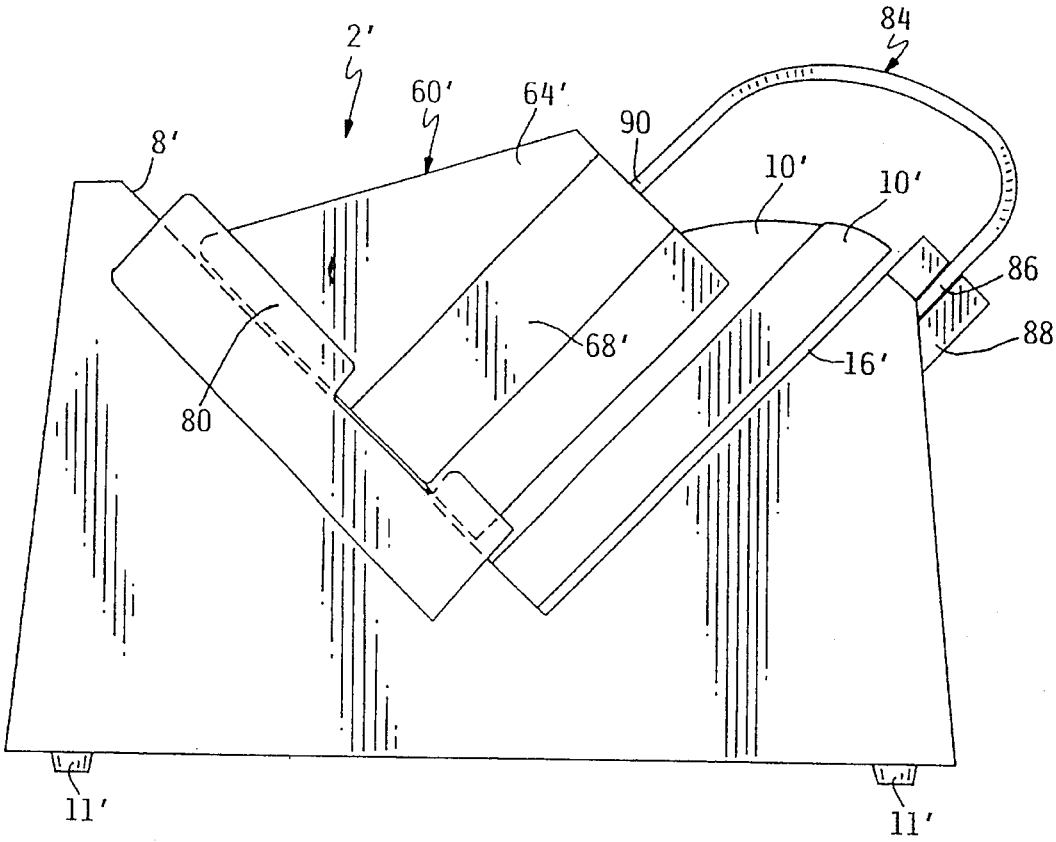
FIG. 7 is a side elevational view of a second embodiment of a bread slicer according to this invention.

Referring now to FIG. 7, a second embodiment of a bread slicer according to this invention will be illustrated as 2'. To the extent that bread slicer 2' has the same or identical components to slicer 2, the same reference numerals will be used to describe them, except that a prime designation will be used with these numerals in conjunction with the second embodiment 2', e.g. bread slicer 2' instead of bread slicer 2.

The primary difference between slicer 2 and slicer 2' is that one side wall 10' thereof is not a full length side wall, but is instead a very short side wall really only for the purpose of containing the knife slot 16'. Thus, this side of slicer 2' does not have a fixed full length side wall 10', but is essentially open above the level of bottom wall 8'. However, gripping member 60' is now built to form, in effect, the remainder of side wall 10' with gripping member 60' being transversely slidable on bottom wall 8'. A stop member 80 is provided on the side of slicer 2' to prevent gripping member 60' from sliding off bottom wall 8.

Gripping member 60' could be constructed to slide in a transverse slot 62 as in the embodiment of FIGS. 1–6. However, it is preferred in this embodiment that there be no transverse slot 62 such that the lower edge of face 64' of gripping member 60' would simply be received against, or be spaced closely above, bottom wall 8'. A U-Shaped pivot rod 84 would be used to connect gripping member 60' to slicer 2 and to guide it during its movement. Preferably, pivot rod 84 would have a first pivot end 86 that is pivotally received in a bearing or bushing 88 on slicer 2. Pivot rod 84 would also be pivotally connected at its second end 90 to the upper end of gripping member 60'.

In using gripping member 60' of slicer 2', gripping member 60' could be moved inwardly transversely towards the other side wall of slicer 2' simply by pushing inwardly on face 64' the pivot rod 84 pivoting about its upper end 86 to allow this inward movement. Thus, gripping member 60' will allow the side of bread loaf 4 to be gripped without direct contact from the user's fingers. As the end of loaf 4 is shortened due to slicing, the upper end of loaf 4 will at some point pass the position or location of gripping member 60'. Gripping member 60' could then be pivoted about its lower end 90 until face 64' of gripping member 60' generally points down towards the end wall of slicer 2'. Thus, gripping member 60' could thereafter also serve as the bread pusher member. Accordingly, gripping member 60' integrates the functions of gripping member 60 and bread pusher member 40, while also serving as a portion of the side wall of slicer 2'.

Slicers 2 and 2' have been described herein for use with loaves of bread. However, they are not limited for use with only bread, but could be used to cut off slices from various food products that might be provided in larger loaves or chunks, such as slices of meat from loaves of processed meat or slices of cheese from cheese loaves.

Various modifications of this invention will be apparent to those skilled in the art. Since crumbs are prone to accumulate at the junction between end wall 12 and bottom wall 8, some means could be included in slicer 2 for allowing these crumbs to fall out of or be removed from channel 6. For example, various openings 82 could be provided in the area adjacent end wall 12 to allow such crumbs to fall or be swept out of channel 6. If such openings are provided in bottom wall 8 in the area between front face 14 and knife slots 16, bottom wall 8 would have a fenestrated or slotted surface in this area with the openings being provided between the remaining solid portions of bottom wall 8 to provide sufficient support for the cut bread slice and any adjustment plates 20 that are present, in this area. Accordingly, this invention is to be limited only by the appended claims.

I claim:

1. A food product slicer for use with a hand-held knife for cutting slices of food product from a loaf of food product, which comprises:

(a) a substantially planar bottom wall on which a loaf of food product may be laid for cutting a slice of food product off one end of the loaf;

(b) two transversely spaced apart, substantially planar side walls which are fixedly secured to the bottom wall along the sides thereof and with the bottom wall received between the side walls to define a generally U-shaped channel in which the loaf is received during a slicing operation, the side walls extending over substantially the entire length of the bottom wall with each side of the bottom wall being fixedly attached to one of the side walls, and wherein the side walls have undersides that are shaped for supporting the U-shaped channel formed between the side walls and the bottom wall on a substantially horizontal surface;

(c) an upright, substantially planar end wall fixedly secured to the bottom wall and the side walls and extending perpendicularly upwardly from the bottom wall with the end wall also being received between the side walls, wherein the end wall includes a front face against which the one end of the food product loaf may be abutted when cutting a slice off the one end of the loaf;

(d) means fixed relative to the end wall for guiding an elongated knife blade of a hand-held knife in a direction parallel to the end wall for cutting a food product slice having a first pro-determined thickness equal to the distance between the front face of the end wall and the knife guiding means;

(e) wherein the bottom wall is inclined relative to the horizontal to have an upper and a lower end, wherein the end wall is secured to the bottom wall proximate to the lower end thereof to allow the loaf to self feed down into engagement with the end wall with the loaf sliding downwardly in the U-shaped channel formed between the side walls and the bottom wall until it engages against the end wall; and (f) selectively usable means located between the end wall and the knife guiding means during use for selectively adjusting the thickness of the food product slices by spacing they one end of the food product loaf away from the end wall by at least a first predetermined distance, wherein the thickness adjusting means comprises at least one sliding plate that is configured to slide in and out of the U-shaped channel.

2. A food product slicer as recited in claim 1, wherein the knife guiding means comprises aligned knife slots extending through at least a portion of the side walls which knife slots are longitudinally aligned with one another to allow a blade of the knife to extend between and through the aligned knife slots.

3. A food product slicer as recited in claim 2, wherein the aligned knife slots are spaced a short distance from the end wall.

4. A food product slicer as recited in claim 1, wherein the knife guiding means is located above the end wall.

5. A food product slicer as recited in claim 1, wherein the angle of inclination of the bottom wall is in the range of from 30° to 45° relative to the horizontal.

6. A food product slicer as recited in claim 1, wherein the undersides of the side walls are provided with a plurality of downwardly depending feet that engage against the substantially horizontal surface.

7. A food product slicer for use with a hand-held knife for cutting slices of food product from a loaf of food product, which comprises:

(a) a substantially planar bottom wall on which a loaf of food product may be laid for cutting a slice of food product off one end of the loaf;

(b) two transversely spaced apart, substantially planar side walls which are fixedly secured to the bottom wall along the sides thereof and with the bottom wall received between the side walls to define a generally enclosed U-shaped channel in which the loaf is received during a slicing operation;

(c) a substantially planar, upright end wall secured to the bottom wall and extending upwardly therefrom, wherein the end wall includes a front face against which the one end of the food product loaf may be abutted when cutting a slice off the one end of the loaf;

(c) means fixed relative to the end wall for guiding an elongated blade of the hand-held knife in a direction parallel to the end wall for cutting a food product slice having a first pre-determined thickness equal to the distance between the front face of the end wall and the knife guiding means;

(d) wherein the bottom wall is inclined relative to the horizontal to have an upper and a lower end, wherein the end wall is secured to the bottom wall proximate to the lower end thereof to allow the loaf to self feed down into engagement with the end wall; and (e) further including at least one opening provided in the bottom wall only at the junction between the end wall and the bottom wall to allow crumbs to fall or be swept down the substantially planar bottom wall and to be confined within the generally enclosed U-shaped channel until such crumbs reach the junction between the end wall and the bottom wall and are then able to fall downwardly through the opening(s).

* * * * *